US007895850B2

(12) United States Patent
Kitsch

(10) Patent No.: US 7,895,850 B2
(45) Date of Patent: Mar. 1, 2011

(54) MODULATING PROPORTIONING REVERSING VALVE

(75) Inventor: William J. Kitsch, Philadelphia, PA (US)

(73) Assignee: Comforture, L.P., Mohnton, PA (US)

( * ) Notice: Subject to any disclaimer, the term of this patent is extended or adjusted under 35 U.S.C. 154(b) by 683 days.

(21) Appl. No.: 11/406,220

(22) Filed: Apr. 17, 2006

(65) Prior Publication Data

US 2006/0230770 A1 Oct. 19, 2006

Related U.S. Application Data

(60) Provisional application No. 60/594,539, filed on Apr. 15, 2005, provisional application No. 60/714,573, filed on Sep. 7, 2005.

(51) Int. Cl.
*F25B 49/00* (2006.01)

(52) U.S. Cl. ..... 62/176.6; 62/150; 62/160; 62/272; 62/278

(58) Field of Classification Search ..... 62/150, 62/160, 176.6, 272, 278
See application file for complete search history.

(56) References Cited

U.S. PATENT DOCUMENTS 2,757,642 A 8/1956 Raney
4,139,355 A 2/1979 Turner et al.
4,209,994 A 7/1980 Mueller et al.
4,318,425 A 3/1982 Marks
4,573,497 A 3/1986 White
4,760,709 A * 8/1988 Aoki et al. ..... 62/324.6
5,105,629 A 4/1992 Parris et al.
5,440,895 A 8/1995 Bahel et al.
5,507,315 A 4/1996 Parker
5,515,689 A 5/1996 Atterbury
5,690,144 A 11/1997 Takahashi
5,845,502 A 12/1998 Chen et al.
5,878,781 A 3/1999 Parker
5,911,242 A 6/1999 Parker
5,970,723 A * 10/1999 Kinkel et al. ..... 62/121
6,060,856 A 5/2000 Kingsley (Continued)

OTHER PUBLICATIONS

V. C. Mei, Z. Gao and J. J. Tomlinson, "Frost-Less Heat Pump", Building Technology, Engineering Science and Technology Division, Oak Ridge National Laboratory, 10 pages, 2002.

*Primary Examiner*—Henry Yuen
*Assistant Examiner*—Azim Rahim
(74) *Attorney, Agent, or Firm*—Knoble Yoshida & Dunleavy, LLC

(57) ABSTRACT

A method of operating a reversible heat pump system includes steps of sensing an outdoor air temperature with a first sensor and sensing at least one condition of an outdoor heat exchanger coil with a second sensor. Input from the first and second sensors is then electronically analyzed to predict when frosting may occur on an outdoor heat exchanger coil. A proportioning reversing valve is modulated in response to this analysis in order to direct a controlled proportional back-pressure flow of pressurized refrigerant from a pressure side of a compressor into the outdoor heat exchanger coil while pressurized refrigerant is continued to be supplied to an indoor heat exchanger coil. As a result, the pressure and temperature of refrigerant within the outdoor heat exchanger coil is raised to at least an extent necessary to prevent frosting on the outdoor heat exchanger coil. The steps are preferably performed continuously in a feedback control loop during operation of the reversible heat pump system as a heat pump.

22 Claims, 5 Drawing Sheets

U.S. PATENT DOCUMENTS

| | | | | |
|---|---|---|---|---|
| 6,076,365 | A | 6/2000 | Benatav | |
| 6,244,057 | B1 * | 6/2001 | Yoshida et al. | 62/160 |
| 6,289,931 | B1 | 9/2001 | Sisk et al. | |
| 6,318,095 | B1 * | 11/2001 | Guo et al. | 62/80 |
| 6,343,482 | B1 * | 2/2002 | Endo et al. | 62/324.6 |
| 6,467,284 | B1 | 10/2002 | Chen et al. | |
| 6,491,063 | B1 | 12/2002 | Benatav | |
| 6,505,647 | B2 | 1/2003 | Sasada et al. | |
| 6,572,078 | B1 | 6/2003 | Thomson et al. | |
| 6,684,651 | B1 | 2/2004 | Yoshizawa et al. | |
| 6,698,452 | B2 | 3/2004 | Sisk et al. | |
| 6,745,583 | B2 | 6/2004 | So et al. | |
| 6,826,921 | B1 | 12/2004 | Uselton | |
| 6,830,073 | B2 | 12/2004 | Lee | |
| 6,907,745 | B2 | 6/2005 | Turner et al. | |
| 6,925,823 | B2 | 8/2005 | Lifson et al. | |
| 7,004,246 | B2 | 2/2006 | Gavula | |
| 7,152,416 | B2 | 12/2006 | Lifson et al. | |

* cited by examiner

MODULATING PROPORTIONING REVERSING VALVE

This application claims priority under 35 U.S.C. §119(e) to Provisional Application Ser. No. 60/594,539, which was filed on Apr. 15, 2005 and to Provisional Application Ser. No. 60/714,573, which was filed on Sept. 7, 2005. The disclosures of both documents are hereby incorporated in their entirety as if set forth fully herein.

BACKGROUND OF THE INVENTION

1. Field of the Invention

The invention relates to the field of applied thermodynamics, and in particular to reversing valves for reversible heat pump systems.

2. Description of the Related Technology

Heat pump systems use a refrigerant to carry thermal energy between a relatively hotter side of a circulation loop to a relatively cooler side of the circulation loop. The refrigerant is most compressed at the hotter side of the loop, where a compressor raises the temperature of the refrigerant. Evaporation of the refrigerant occurs at the cooler side of the loop, where the refrigerant is allowed to expand, thus resulting in a temperature drop. Thermal energy is added to the refrigerant on the cooler side of the loop and extracted from the refrigerant on the hotter side, due to the temperature differences between the refrigerant and the indoor and outdoor mediums, respectively, to make use of the outdoor mediums as either a thermal energy source or a thermal energy sink. A reversible heat pump system is essentially an air conditioner that contains a reversing valve that lets it switch between "air conditioner" and "heater." When the reversing valve is switched one way, the heat pump acts like an air conditioner and the inside coil or heat exchanger is cooled, and when the reversing valve is switched the other way it reverses the flow of refrigerant and the inside heat exchanger is heated.

Residential air to air reversible heat pump systems are bidirectional, in that suitable valve and control arrangements selectively direct the refrigerant through indoor and outdoor heat exchanger coils so that the indoor heat exchanger is on the hot side of the refrigerant circulation loop for heating and on the cool side for cooling. A circulation fan passes indoor air over the indoor heat exchanger and through ducts leading to the indoor space. Return ducts extract air from the indoor space and bring the air back to the indoor heat exchanger. A fan likewise passes ambient air over the outdoor heat exchanger, and releases heat into the open air, or extracts available heat therefrom.

These types of heat pump systems operate only if there is an adequate temperature difference between the refrigerant and the air at the respective heat exchanger to maintain a transfer of thermal energy. For heating, the heat pump system is efficient provided the temperature difference between the air and the refrigerant is such that the available thermal energy is greater than the electrical energy needed to operate the compressor and the respective fans. For cooling, the temperature difference between the air and the refrigerant generally is sufficient, even on the warmest days.

Heat pumps systems can be extremely efficient in their use of energy. However, one problem with most heat pumps is that the heat exchanger coils in the outside air may collect frost and ice. The speed of the frost build-up is strongly dependent on the ambient temperature and the humidity ratio. Coil frosting results in lower coil efficiency while affecting the overall performance (heating capacity and coefficient of performance) of the unit. The heat pump has to melt this ice periodically, so most conventional reversible heat pump systems will temporarily switch back to air conditioner mode, even in the dead of winter, to heat up the coils. This is also known as refrigerant cycle inversion. To avoid pumping cold air into the house in air conditioner mode, the heat pump also typically activates a backup electrical or fossil fuel burning heat source to heat the cold air that indoor heat exchanger creates when the refrigerant cycle is inverted. Once the ice is melted, the heat pump switches back to heating mode and turns off the backup source of heat. In most residential heat pump systems, the source of backup heat is electrical resistance heating, which is expensive and very energy intensive.

Coil defrosting using the refrigerant cycle inversion technique negatively impacts the overall efficiency of the reversible heat pump system unit because the hot refrigerant in the unit that provides the desired heat is actually cooled when the refrigerant cycle is inverted. Moreover, interrupting the operation of the compressor is unhealthy to the compressor and requires waiting several minutes before its operation can be resumed. Frequent interruption of the system also tends to reduce the useful life of the compressor and the fan.

U.S. Pat. No. 6,491,063 to Benatav discloses an air conditioning system having a rotary change-over valve that can be operated to shunt a part of the refrigerant from the high pressure port of the compressor to the low pressure port to thereby control temperature within the system without interrupting the compressor. Another described additional function is to restrict the effective cross-sectional area of the low pressure port with respect to the heat-exchanger connected to it, to thereby control the output of the system without interrupting the operation of the compressor. A further control function is to selectively open and close the pilot valve, not only for making a change-over operation, but also for controlling leakage from the high pressure port to the low pressure port for temperature control purpose in any position of the valve. The reference states that the disclosed system can be operated to prevent frosting. It states that the shunting of refrigerant could be performed periodically by periodically controlling the amplitude of the leakage, the time interval of each period of leakage, and/or the frequency at which the leakage is effected. It also discloses that the leakage may be continuous, wherein a continuous leakage could be provided having a magnitude depending on the output of the temperature sensor to prevent frosting, that it could be controlled manually or automatically in response to temperature.

The temperature of the heat exchanger at the time at which defrosting is initiated, the time interval for which the defrosting is conducted and the final temperature of the heat exchanger at the end of the defrosting interval impacts the overall efficiency of the heat pump system whether the refrigerant cycle inversion method or the shunt method disclosed in Benatav is used. Of particular importance to system efficiency is the heat exchanger temperature at which defrosting is initiated, and the relationship of that temperature to the surrounding air temperature and possibly the humidity of the air. The Benatav system fails to take such criteria into account when determining defrost cycle control.

A compressor's discharge temperature is often overlooked when troubleshooting faulty heat pump systems. It is typically not taken into account when factoring system efficiency, or correcting or altering system performance during the run cycle. However, compressor discharge temperature is very important because it indicates the amount of heat absorbed in the evaporator and suction line, plus any heat generated by the process of compression. Because the compressor's discharge temperature is superheated, a pressure-temperature relationship does not exist. The discharge temperature must be read directly on the discharge line at 1" to 2" from the compressor. The discharge temperature should never exceed 225 degrees F., since higher temperatures will carbonize and breakdown refrigeration oils, which are needed to lubricate the compressor. Sustained high temperatures can also damage other components of the compressor. The three causes of high discharge temperature are: High Condensing Temperature; Low Evaporator Temperatures and Pressures; and High Compression Ratios. As anyone familiar with the art understands these terms, their common causes, properties and relationships, they will not be discussed here for the sake of mere definition, except that: Compression Ratio=Absolute discharge pressure divided by Absolute suction pressure. (e.g. 400 psi discharge/100 psi suction=4:1 Compression Ratio.)

A need exists for an improved reversible heat pump system and a method of operating such a system that is more efficient than conventional systems and that is economical to produce, install, and retrofit into existing systems and to operate.

SUMMARY OF THE INVENTION

Accordingly, it is an object of the invention to provide an improved reversible heat pump system and a method of operating such a system that is more efficient than conventional systems and that is economical to produce, install, and retrofit into existing systems and to operate.

In order to achieve the above and other objects of the invention, a method of operating a reversible heat pump system according to a first aspect of the invention includes steps of sensing an outdoor air temperature with a first sensor; sensing at least one condition of an outdoor heat exchanger coil with a second sensor; electronically analyzing input received from said first sensor and said second sensor to predict when frosting on said outdoor heat exchanger coil may be imminent; modulating a proportioning reversing valve in response to said electronic analysis when it is predicted that frosting on said outdoor heat exchanger coil may be imminent, said proportioning reversing valve directing a controlled proportional backpressure flow of pressurized refrigerant from a pressure side of a compressor into said outdoor heat exchanger coil while pressurized refrigerant is continued to be supplied to an indoor heat exchanger coil, whereby the pressure and temperature of refrigerant within said outdoor heat exchanger coil is According to a second aspect of the invention, a method of operating a reversible heat pump system includes steps of (a) determining a volumetric efficiency of a compressor within a reversible heat pump system; and (b) modulating a proportioning reversing valve in response to adjust said volumetric efficiency of said compressor, said proportioning reversing valve directing a controlled proportional flow of pressurized refrigerant from a pressure side of a compressor into an evaporator heat exchanger coil while pressurized refrigerant is continued to be supplied to a condenser heat exchanger coil, whereby the pressure and temperature of refrigerant within the evaporator heat exchanger coil is temporarily raised.

A reversible heat pump system according to a third aspect of the invention includes a compressor; an indoor heat exchanger; a first expansion valve; a second expansion valve; an outdoor heat exchanger; a linear proportioning reversing valve that is communication with both an inlet and an outlet port of the compressor, the linear proportioning reversing valve being configured to permit the reversible heat pump system to be switched over between heat pump operation and air-conditioning operation, the linear proportioning reversing valve further being constructed and arranged to allow for a controlled proportional backpressure flow of pressurized refrigerant from the outlet of the compressor through the linear proportioning reversing valve into both the indoor heat exchanger and the outdoor heat exchanger simultaneously, the linear proportioning reversing valve comprising a valve member that is mounted for movement along a linear path of travel; and a controller, the controller being constructed and arranged to control operation of the linear proportioning reversing valve.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
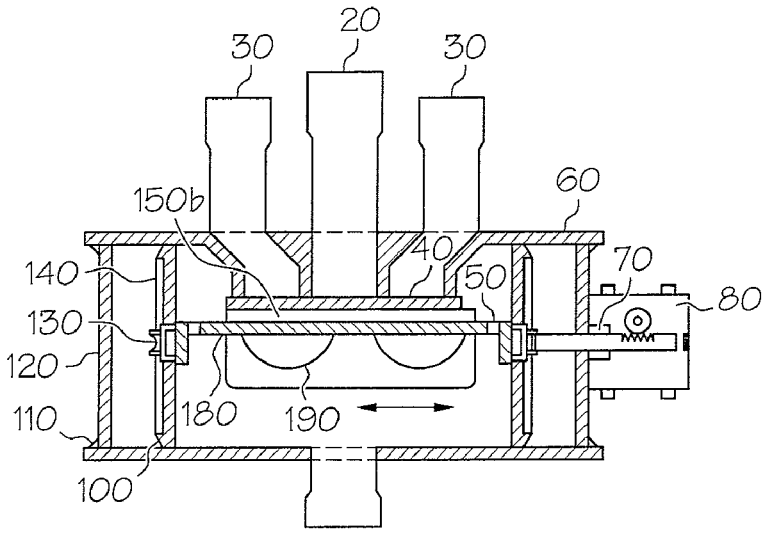
FIG. 1 is a cross-sectional view of a motorized lateral-travel valve constructed according to one embodiment of the present invention.
Figure 2:
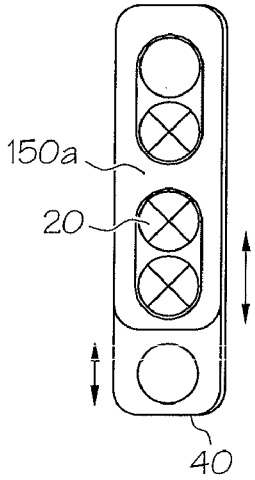
FIG. 2 is a cross-sectional diagram of a PTFE seat, illustrating the relationship of travel of seat and buckets of the valve of FIG. 1.
Figure 3:
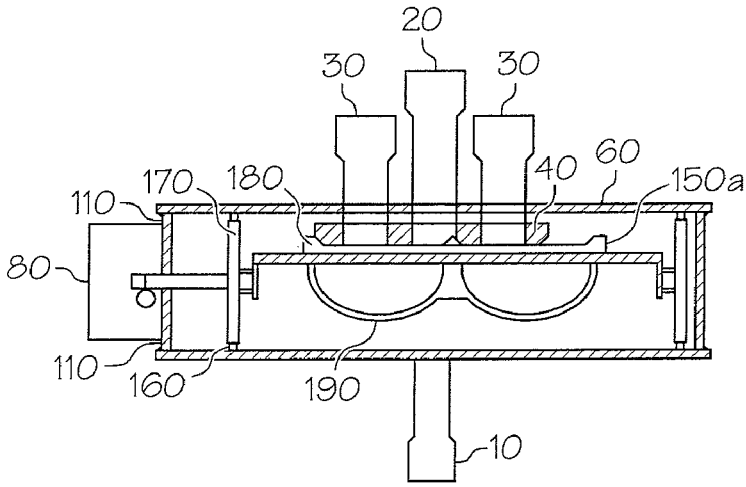
FIG. 3 is a cross-sectional view of a valve constructed according to an alternative embodiment of the invention, depicting an improved valve, seat and guide arrangement.
Figure 4:
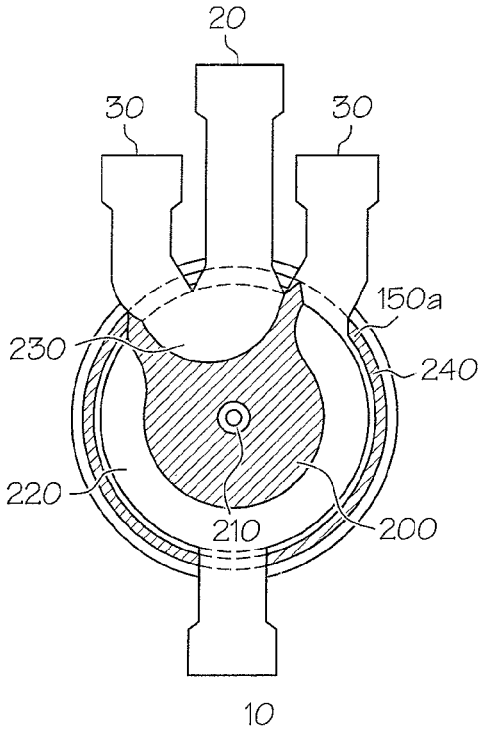
FIG. 4 is a cross-sectional view of a rotating valve assembly constructed according to one embodiment of the present invention.
Figure 5:
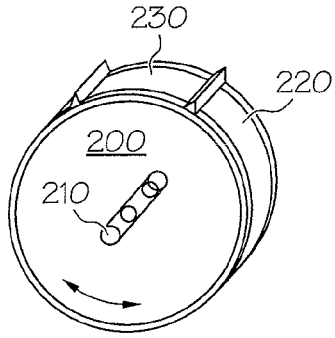
FIG. 5 is a perspective view of a rotating valve assembly.
Figure 6:
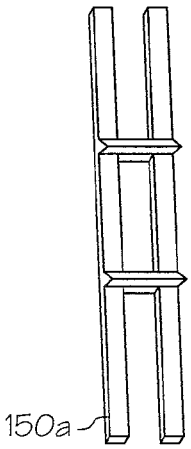
FIG. 6 is a top plan view of a PTFE laminate as laid-out flat.
Figure 7:
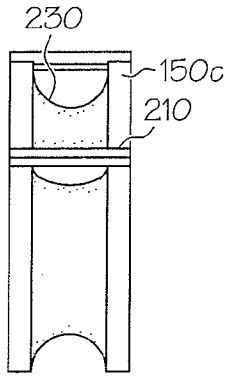
FIG. 7 is a side elevational view of rotating valve disk.
Figure 8:
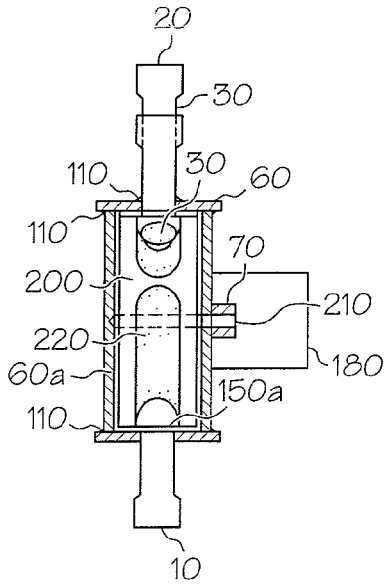
FIG. 8 is a cross-sectional view of the servo driven rotating proportioning reversing valve.

Referring now to the drawings, wherein like reference numerals designate corresponding structure throughout the views, and referring in particular to FIGS. 1-8, a reversible heat pump system that is constructed according to a first embodiment of the system is shown. Components of the system shown in FIGS. 1-8 include a hot gas inlet 10, a compressor suction connection port 20, a coil connection port 30, a valve plate 40, a flow through chamber 50, a valve body 60, a hermetic shaft seal 70, a gear reduction bipolar step motor or servo 80, a neoprene guide cup 90 with spring tabs, a conventional spring tab 100 (on the interior concave surface of the guide cup 90), a brazing 110 of the valve body 60, an end plate 120, a screw 130, a guide cup backer plate 140 and a circular PTFE laminate continuous seat 150. The continuous seat 150 includes PTFE seats 150*b*, 150*c*, which are formed out of a circular continuous PTFE laminate plate. The system further includes an 'O' ring 160, an improved guide plate 170, a servo motor 180, a double valve bucket 190, a rotating valve disk 200, a rotational shaft 210, a hot gas chamber 220, a valve bucket channel 230, and a valve body 240, which may be made of brass or some other appropriate material.

Conventional solenoid and pilot valve-controlled, quick-acting reversing valves utilize a single 'bucket' configuration to divert refrigerant flow between the compressor suction system ports and the coil ports, respectively. The main valve is gas actuated, whereby the slide assembly may be shifted rapidly side to side over 100% of its travel or throw via differential system refrigerant gas pressure as it is supplied and controlled by the positioning of the pilot valve.

The system, in its laterally sliding or linear travel embodiments, utilizes a double diverting bucket arrangement, which provides more precise control in proportioning the refrigerant to the respective ports than a motorized version could. Therefore, the double bucket effectively improves flow characteristics, reduces hysteresis, and minimizes valve 'hunting'. However, motorized single bucket designs with any of the potential seat variations (flat, chamfered, etc.) are workable as well, and can be more economical to produce, and are equally within the scope of the invention.

The system is preferably modulating motor driven via bi-polar step motor, servomotor, or any other appropriate incremental or modulating motor. The actuator moves the valve assembly in minute steps linearly as controlled by an algorithmic control output, and as dictated by data input from a controller, in order to precisely proportion refrigerant flow through the valve ports. This is accomplished by opening and closing the ports respectively as the valve slides to or fro. The bucket(s) and discs, or seats, and chambers are rounded so as to aid the flow of refrigerant with minimal pressure drop.

The main mechanical components of the system may be: 1) A four-way valve body with flow chambers which, in conjunction with the lateral sliding valve assembly directs the flow of refrigerant to the appropriate valve ports in the valve body. 2) A lateral motion sliding bucket and disc valve assembly; or 2a) A lateral motion sliding multi-seat valve assembly, or 2b) a lateral motion sliding double bucket and multi-seat valve assembly. The assemblies, described in 2, 2a, & 2b above, move side to side, thereby opening and closing ports respectively, in direct or reverse proportion to one another (as relevant), thereby directing the flow of refrigerant. 3) A Lateral guide axis, axes, shaft, shafts, or discs, hold the valve assembly to tolerance, and link to the motorized actuator to provide motion. 4) A motor drive assembly (e.g. a bi-polar gear reduction step motor or servo motor) and stem or shaft link to the chosen axis described in 3 above. 5) A sliding "O" ring refrigerant seal, a flexible diaphragm seal, or a magnetic coupler seal arrangement that isolates the actuator internals from the refrigerant system. Alternatively a simple cylindrical seal may be used through which the motor stem or shaft passes with a stationary seal between the motor housing and the valve body where the actuator internals are in contact with the refrigeration system, or other appropriate refrigerant seal.

A rotary valve may be used in lieu of the lateral sliding valve type. An external magnetic seal and coupler drive actuator may be used in lieu of an actuator with a stem, or shaft, linked to the valve assembly, thereby eliminating the need for a shaft seal, but driving the cost upward. Also, through somewhat complex arrays of existing solenoid valves, EEV's (electronic expansion valves) and/or electronic hot gas valves and check valves piped and controlled per the respective potential application(s) and/or sequence(s) of operation. Also, complicated designs exist that employ dual coils with complex arrays of valves and controls. The valve assembly may be configured to provide individual, and potentially disproportionate modulated control of the ports with relation to one another by utilizing dual independent actuators that are controlled individually.

This system can also be used to modulate water flow in domestic booster systems, chilled or hot water (hydronic) systems, or in any application in which proportional bypass of fluids, or where reversing the flow of fluids is desired.

In general, the system in its preferred embodiment is a modulating, proportioning reversing valve for heat pump, air conditioning and refrigeration systems, which employs a four-way valve body with flow chambers, a lateral motion assembly, axes, shafts or discs that hold the valve assembly together, a motor drive assembly and a refrigerant seal, to modulate hot gas refrigerant and suction vapor proportionally at any point in the stroke of the valve. A rotating valve assembly is shown also, which embodies particular benefits, while capable of performing all the functions of the lateral sliding valve type.

In a heat pump heating cycle, compressor discharge hot gas is proportionally bypassed back to the compressor preferably downstream of the expansion valve control point, e.g., electric expansion valve (EEV) sensor, or thermal expansion valve (TXV) bulb, and ahead of the accumulator. The outdoor coil is starved for expanded liquid refrigerant, the compressor partially unloads by external operation and suction temperature is raised, and the outdoor fan is slowed or shut down accordingly, thereby defrosting the outdoor coil while in the heating cycle to accomplish continuous frostless operation. An indoor coil bypass solenoid is opened for very low outdoor ambient temperatures to retard the condensing of the refrigerant in the indoor coil, and indoor fan speed is controlled. Appropriately controlled, modulating of the reversing valve also provides infinite modulated capacity control in heat pump, air conditioning, and refrigeration systems for energy savings.

In a preferred embodiment, the valve is mid-point (balance point) start-up capable for fully unloaded compressor starts (and/or stops) and allows the compressor load to be ramped up (or down) thereby by gradually applying (or decreasing) the load. This feature is particularly desirable in commercial and industrial applications where electric utility demand charges are applicable, and it prolongs compressor life. When augmented by soft (frequency controlled or ramped) start or part winding start, it provides unparalleled control combinations of extraordinary energy management benefits particularly in larger, and 3 phase voltage commercial/industrial systems.

The valve when appropriately controlled also allows for precise superheat control; dehumidification in air conditioning and refrigeration systems; and/or frostless defrost control in refrigeration systems. The invention may be used for simple reversing of refrigerant alone without proportioning, for conventional changeover from heating to cooling and back, with a minimum of control.

Of particular benefit in the rotating valve design is the ability to easily manufacture and assemble simple, fitted, modular internal components with minimal or no brazing operations during assembly. A component valve plate ring may be inserted tightly or sealed if desired, into the valve body separately (in lieu of machining or milling the valve plate integrally into the valve body) which lowers cost of production. Of even greater benefit, this feature allows for the valve plate to be of a dissimilar material to the valve body. This is of particular benefit, since the industry, for reasons of efficiency and performance, has been seeking a way to minimize crossover conduction of heat from hot gas to suction vapor within reversing valves, due to their brass construction.

The usage of this rotary valve, with its solid continuous valve plate ring, allows the valve plate to be fabricated from suitable materials such as PTFE, ceramics, or plastics with very low thermal conductivity ratings (W/m K). (E.g. Brass is 109.0 (W/m K) whereas PTFE is 0.195 (W/m K)) Moreover, the flat valve body sides may be readily fitted with flat internal insulating disks to complete the contiguous coverage of all metallic surfaces within the valve, which would normally come in contact with refrigerant. Also, the entire valve disk may be fabricated, machined, or molded of a solid piece of material with low thermal conductivity as well, or the laminate seat alone. Simple ring seals (not shown) may wipe the sides of the valve body to eliminate even the slightest bypass of refrigerant from discharge to suction. Moreover, when the valve plate and seat disk are slanted or tapered they are self-seating when lapped together and wedged at a desired tension, as provided by a spring or other means.

The valve is fully interfacial when the appropriate algorithmic control is employed. It is capable of precise control of proportioned fluid at any point in its stroke or range with consistent repeatability. The controls can "look at" or monitor, and control: defrost cycles and temperatures; approach temperatures; compressor ampere draw and billing demand in commercial systems; compressor superheat; system capacity; controlled space temperature; humidity in the controlled space; compressor desuperheating temperature; compressor discharge temperature, system supply and return temperatures and conditions, and any other desired parameter. Through adaptive memory controls, anticipatory recuperative controlled space parameters, and anticipated continuous, frostless defrost thresholds and system relationships heretofore not harmonized in a central control processor may now be fully sequenced. Under most circumstances by 'frost threshold approach method priority' total continuous frostless heat pump operation is readily achievable. Precise, short duration, or pulsed defrost control while in the heat mode of a heat pump (or cooling mode for refrigeration) when and if the need arises, by increasing suction temperature is easily controlled. Slight to full refrigerant flow reversal if desired may be achieved. Sequencing with fan control of both fans both eliminates or greatly minimizes the need for initializing electric back-up resistance heat in heat pump systems, depending on individual system conditions; and/or the need for conventional hot gas bypass or electric defrost assistance in refrigeration applications.

The valve is capable of achieving sustained levels of e.g., capacity control, as more efficient, cooler running compressors become available. The use of this valve also eliminates the need for outside air electric resistance or fossil fuel reheat when so applied, and it is believed this will eventually, due to the modest cost, render every air conditioner produced 'heat pump capable'. Factory (OEM) or field programmable controls will enable selection as to whether the equipment operates as a heat pump or air conditioner only. This will be desirable to optimize assembly line production and to minimize parts, inventory and stock and usage of warehouse space.

The valve provides for a method of user adjustable "direct enthalpy control" technology for controlling the conditioned space employing enthalpic anticipatory adaptive memory that 'remembers' the user's optimum comfort levels and 'creates' or synthesizes and optimizes the "indoor enthalpy" (for lack of a better generic term), to produce any necessary comfort level by generating temperature v. humidity at the most efficient combination thereof to produce the sensible result; not by merely prioritizing choppy shifts from cooling-to approximate dehumidifying in 2-stage cooling modes, or staging in an 'on/off' humidifier in heating mode; rather precisely monitoring and controlling indoor enthalpy directly under all conditions—even in the heating mode when coupled with the humidifier. New designs for hot gas evaporative humidifiers will ensue.

The fully interfacial system with appropriate control is directly interfaced with EEV's (electric expansion valves), EEPR's (electric evaporator pressure reducers) and a host of other controls, including outdoor sensors, and enthalpy-based economizer systems or indoor swimming pool recirculating systems, for example. It is also possible to have a three (3) pipe motorized as well as a four (4) pipe reversing valve, and non-conventional systems as discussed. The 3 way or 3 port valve reverses refrigerant from common and left ports to common and right ports and is modulating. The overall capabilities of the valve in its forms provides several means of earning U.S. Department of Energy (DOE) SEER (Seasonal Energy Efficiency Ratio) Points for air conditioning, and HSPF (Heating Season Performance Factor) Points for heat pumps, respective to its myriad applications.

Conventional systems typically have a quick acting valve that operates only in the 100% open or 100% closed (i.e.: full heating or full cooling mode; full left or full right) positions. In the construction of a single scoop, or single bucket, valve in accordance with has a 'free floating' scoop (or bucket) involves laying in a receptacle slot in the carrier, with integral Teflon-like (polytetrafluoroethylene—PTFE or other such appropriate material) seat in the shape of inner and an outer disproportionate ovals that form elliptical 'sails' or 'tongues' at either end in order to increase available surface area exposed to high side pressure from underneath, which is thereby sufficiently positively held up against the valve plate by refrigerant pressure when the system is in operation (the pressure from the underside being greater than the pressure inside the scoop), for the purpose of turning the fluid direction (usu. Refrigerant) 180 degrees and diverting it to respective ports With minimal bypass of fluid across the seat.

Figure 9:
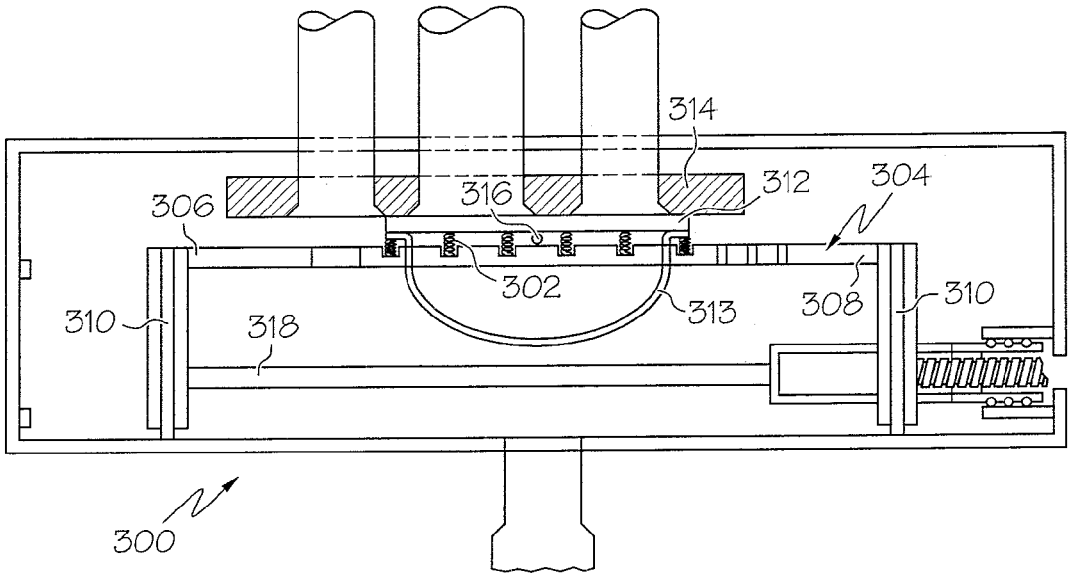
FIG. 9 is a cross-sectional view of a single scoop valve body for a modulating reversing valve that is constructed according to a preferred embodiment of the invention.
Figure 10:
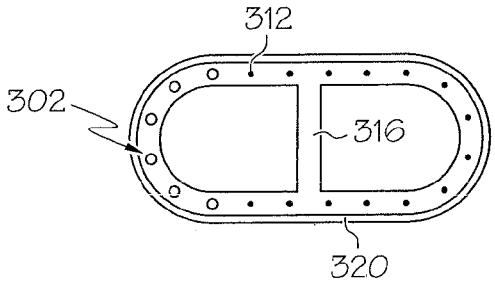
FIG. 10 is a top plan view of the scoop constructed according to the embodiment of FIG. 9 when looking into the cavity.
Figure 11:
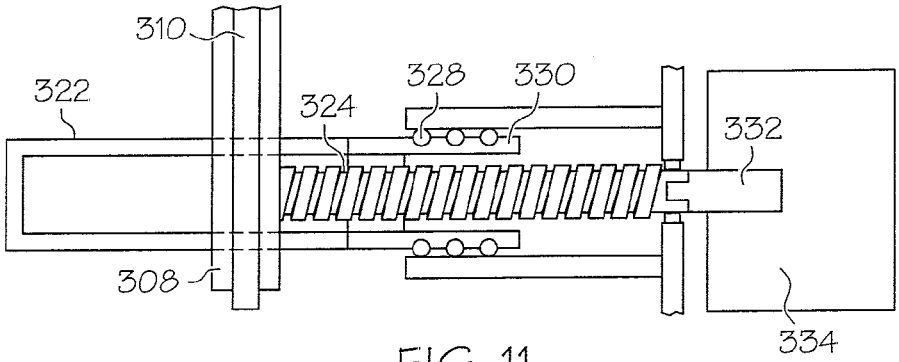
FIG. 11 is a fragmentary cross-sectional view of the shaft seal and screw detail in the embodiment of the invention that is depicted in FIG. 9.

FIGS. 9, 10 and 11 show a modulating motorized proportioning reversing valve 300 (4 way) that is constructed according to a preferred embodiment of the invention. The valve 300 in its lateral sliding form is a slow acting, proportioning valve and at points between its full range of travel will lose the differential pressure necessary to hold up the scoop and seat assembly as in conventional valves due to loss of adequate differential pressure and other factors such as turbulence. Therefore the valve 300 is assisted by a series of springs 302 between the carrier 304 and the scoop assembly arranged around the perimeter underside of the scoop/seat assembly. Moreover, conventional scoop/seat assembly 'sails' are of sufficient surface area to considerably close off port diameters so as to significantly interfere with the full-volume flow of fluid at points midway in the valve stroke. Valve 300 includes a PTFE seat 312 that is attached to a valve scoop 313 that is mounted for lateral movement with the carrier 304. The PTFE seat 312 and rim 320 of the valve scoop 313 slidingly bears against the valve plate 314. Stabilizer bars 316, 318 are provided for ensuring internal stability of the valve assembly. Therefore valve 300, with the aid of the springs 302, provides superior seating, ending on valve size, shape, and spacing between ports of any respective variation of a manufactured valve, which will determine optimum flow characteristics, and an oval seat 312 of equal or near equal width of the seat area so as not to interfere with the port openings at any point in the travel (stroke) of the valve, allows the valve 300 to operate at minimum pressure drop through the valve and at full system flow at all times. The carrier support ends 306, 308, which are grooved to accept PTFE anti-friction rings 310, are semi-circular to cut down weight and necessary raw materials, but may be constructed as full disks, so long as they have relief holes provided to equalize pressure between the carrier side of the support end and the end of the valve body itself, so as not to compress gasses in the cavity as the valve moves side to side.

The double scoop version of the valve 300 has slightly better flow characteristics and is constructed in the same fashion, but the single bucket version has a shorter overall valve length, making it more adaptable to smaller systems due to space limitations in the equipment. Either type of lateral sliding valve 300 may incorporate the chamfered seat design but requires significantly more complex machining in manufacture. The shaft seal is accomplished with a closed-end internally threaded nut cylinder 322 that accepts the motor drive screw 324 (such as an Acme threaded screw).

As FIG. 11 shows, the nut cylinder 322 is attached to the nearest carrier support 308 on the interior side between the support and the bucket preferably, to keep the valve body as short as possible by accomplishing most of the motion inside the valve body. The nut cylinder 322 is grooved to accept 2 'O' rings 328, which themselves ride inside a guide cylinder 330 with stops on either end to prevent over-travel beyond the point of sealing. The shaft screw 324 is coupled to the motor shaft 332 outside the valve body. With this seal configuration the motor 334 may be removed from the valve for service without loss of refrigerant, and the valve 300 may be set in full heat, or full cooling position manually with a simple threaded tool that matches the shaft screw thread.

One significant benefit of the modulating motorized proportioning reversing valve 300 that is depicted in FIGS. 9-11 is that it is engineered to have form factor (i.e. a size and shape) that is about the same as conventional reversing valves that are used in conventional reversible heat pump systems. In addition, reversing valve 300 is provided with fitting locations that are similarly placed and sized to the fitting locations of conventional reversing valves that are used in conventional reversible heat pump systems. As a result, a conventional reversible heat pump system can conveniently be retrofitted by removing the conventional reversing valve and the conventional controller board and replacing it with the reversing valve 300 and a controller 350 as described below. In addition to post consumer retrofitting, the interchangeability of reversing valve 300 with conventional reversing valves makes a reversing valve 300 especially adaptable for inclusion in otherwise conventional originally manufactured equipment without requiring extensive redesign of the equipment. Accordingly, a method of operating a manufacturing facility for manufacturing reversible heat pump systems according to the invention would include making reversing valves 300 constructed according to the invention available and incorporating reversing valves 300 into otherwise conventional reversible heat pump systems.

Figure 12:
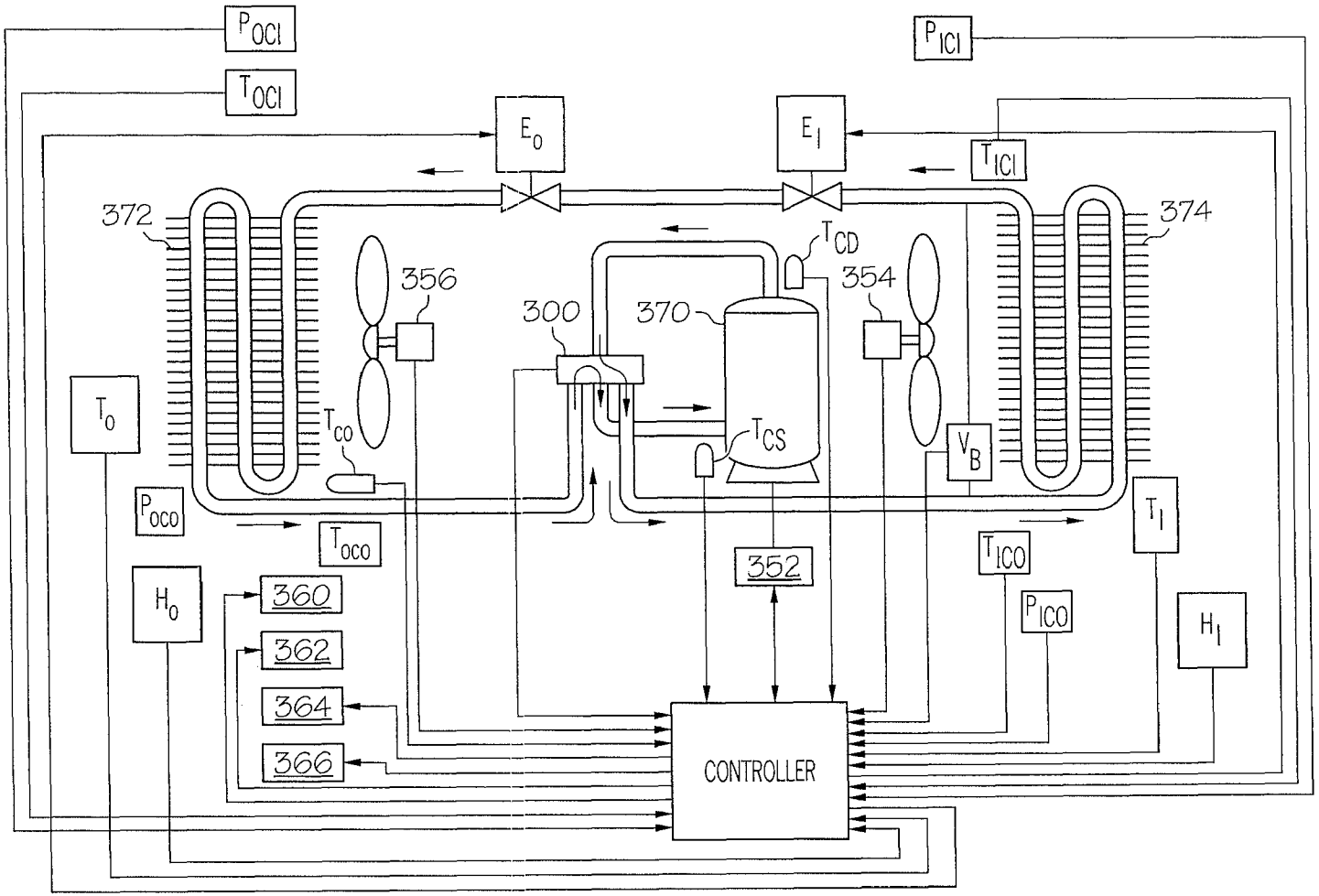
FIG. 12 is a schematic diagram depicting piping connections and a control system to be used in the embodiment depicted in the FIG. 9.

A heat pump system constructed according to the preferred embodiment of the invention is shown schematically in FIG. 12 and preferably includes a control system for controlling operation of the heat pump system and particularly operation of the proportioning reversing valve 300. The control system permits a process according to a preferred embodiment of the invention to be performed that includes steps of sensing an outdoor air temperature with a first sensor $T_O$, sensing at least one condition of an outdoor heat exchanger coil with a second sensor $T_{CO}$, electronically analyzing input received from the first sensor and the second sensor to predict when frosting on the outdoor heat exchanger coil may be imminent, and modulating the proportioning reversing valve in response to the electronic analysis when it is predicted that frosting on said outdoor heat exchanger coil may be imminent. The proportioning reversing valve 300 will direct a controlled proportional backpressure flow of pressurized refrigerant from a pressure side of a compressor 370 into the outdoor heat exchanger coil 372 while pressurized refrigerant is continued to be supplied to an indoor heat exchanger coil 374, whereby the pressure and temperature of refrigerant within the outdoor heat exchanger coil 372 is raised to at least an extent necessary to prevent frosting on said outdoor heat exchanger coil 372. Preferably, the steps are performed continuously in a feedback control loop during operation of the reversible heat pump system as a heat pump.

The control system preferably includes a controller 350, shown schematically in FIG. 12, that is constructed and arranged to receive information from the outdoor coil temperature thermistor $T_{CO}$, the outdoor air temperature thermistor $T_O$, the outdoor humidity sensor $H_O$, the compressor discharge temperature thermistor $T_{CD}$, the compressor suction temperature thermistor $T_{CS}$, the compressor electronics module 352, the condenser fan 354, the evaporator fan 356, the indoor space temperature thermistor $T_I$ and the indoor humidity sensor $H_I$. In addition, the controller 350 received information from an indoor heat exchanger inlet temperature sensor $T_{ICI}$ and an indoor heat exchanger outlet temperature sensor $T_{ICO}$. The controller preferably outputs signals to the reversing control valve modulating motor 334, the compressor electronics module 352 which may include a compressor relay, the indoor fan control 354, the outdoor fan control 356, the indoor expansion valve control $E_I$, the outdoor expansion valve control $E_O$, the accessory controls, (e.g. bypass 360, desuperheating 362, and liquid line solenoid valve(s) 364 and the center position proximity circuits 366, or step-count proximity ability circuits. Refrigerant bypass valves 360 in the context of the invention may be used in various ways, the most common of which is either full or partial bypass via solenoid or electronic valve as shown in $V_B$ for anti-frost assist. Desuperheating valves 362 are used for diverting liquid refrigerant from within the normal cycle, to inject into the compressor 370 suction via an expansion device in order to aid in cooling the compressor when the suction refrigerant superheat is too high to provide cooling by itself. Liquid line solenoid valves are generally used in pump-down cycles for the sake of oil migration and return issues, and are also used in the off cycle of air conditioners to achieve slightly higher efficiencies. Center position proximity circuits 366 include a proximity sensor located at the valve 300 to indicate to the controller 350 when the valve 300 is at center position. Step-count circuits for the same purpose are sensorless, and proximity recognition is accomplished by the controller 350 anticipating valve position by counting and computing the total number of potential stepper steps in the full range of the valve.

As FIG. 12 also shows, the reversible heat exchanger system also includes a bypass pipe leading from the inlet of the indoor heat exchanger 374 to the outlet of the indoor heat exchanger heat exchanger 374, and a electronic hot gas stepper motor-controlled bypass valve $V_B$ that is controlled by the controller 350 is interposed therein. In conditions of extremely low ambient outdoor air temperatures bypass valve $V_B$ will permit a controlled amount of heating to be provided to the outdoor heat exchanger 372 either in conjunction with a backpressure from the reversing valve 300 or without such a backpressure.

In predicting whether frosting on the outdoor heat exchanger coil may be imminent, the controller 350 will preferably determine an outside air temperature, determine a modulation initiation temperature based at least in part on the outdoor air temperature; and then predict when frosting on said outdoor heat exchanger coil may be imminent based upon whether the temperature of said outdoor heat exchanger coil is sensed to be beneath said modulation initiation temperature. More specifically, in the preferred embodiment of the invention, the controller 350 will begin a time count when the compressor begins to run. In order for the controller to 350 detect the particular conditions necessary to effectuate continuous defrost or frost-free operation while in the heating mode, the controller 350 continuously monitors the feedback from the various inputs, and based on the design temperature difference (TD) between the outdoor air temperature and outdoor coil temperature, after a predetermined period of compressor run time, which in the preferred embodiment is within a range of about 3 minutes to about 25 minutes, and is more preferably within a range of about 7 minutes to about 15 minutes and is most preferably about 10 minutes, performs computations that establish the need to begin modulation of the valve 300 toward raising backpressure to the outdoor heat exchanger coil. The controller 350 first determines the design temperature difference (TD) between the outdoor air temperature and outdoor coil temperature for the heat pump system using an internally stored lookup database, heating table or algorithm that is specific to the model of the heat pump system and the type of refrigerant being used. Heat pumps characteristically operate at a higher TD between outdoor air and refrigerant temperature, at higher outdoor temperature. This TD narrows as demonstrated in Tables 1 and 2 below, which represent typical average performance data for matched 4 ton units using refrigerants R-410a and R-22 respectively. Unit data will vary moderately from size to size, brand to brand, and model to model. Tables for other refrigerants can be calculated from their own thermodynamic property charts, and will operate accordingly within their ranges.

TABLE 1

CALCULATION DATA FOR R-410a REFRIGERANT

| Ref. | Indoor Temp (Deg F.) | Outdoor Temp (Deg F.) | HPR (psig) | LPR (psig) | Design Coil Temp (Deg F.) | TD (Deg F.) |
|---|---|---|---|---|---|---|
| R-410a | 70 | 65 | 425 | 135 | 46 | 24 |
| R-410a | 70 | 47 | 375 | 101 | 33 | 14 |
| R-410a | 70 | 30 | 355 | 80 | 21 | 11 |
| R-410a | 70 | 17 | 295 | 59 | 7 | 10 |
| R-410a | 70 | 0 | 245 | 34 | −17 | 7 |

TABLE 2

CALCULATION DATA FOR R-22 REFRIGERANT

| Ref. | Indoor Temp (Deg F.) | Outdoor Temp (Deg F.) | HPR (psig) | LPR (psig) | Design Coil Temp (Deg F.) | TD (Deg F.) |
|---|---|---|---|---|---|---|
| R-22 | 70 | 65 | 273 | 77 | 46 | 24 |
| R-22 | 70 | 47 | 235 | 58 | 33 | 14 |
| R-22 | 70 | 30 | 220 | 41 | 18 | 12 |

TABLE 2-continued

CALCULATION DATA FOR R-22 REFRIGERANT

| Ref. | Indoor Temp (Deg F.) | Outdoor Temp (Deg F.) | HPR (psig) | LPR (psig) | Design Coil Temp (Deg F.) | TD (Deg F.) |
|---|---|---|---|---|---|---|
| R-22 | 70 | 17 | 182 | 30 | 7 | 10 |
| R-22 | 70 | 0 | 159 | 18 | −17 | 7 |

The controller 350 then calculates a maximum delta (MD) temperature having units in the preferred embodiment of degrees Fahrenheit. When the measured outdoor coil temperature falls beneath the measured outdoor temperature by more than the design temperature difference (TD) plus the maximum delta (MD) temperature, controller 350 will initiate modulation of the valve 300 toward raising backpressure to the outdoor heat exchanger coil. In other words, controller 350 will initiate modulation of the valve 300 toward raising backpressure to the outdoor heat exchanger coil when the measured outdoor coil temperature falls beneath the design coil temperature by more than the calculated maximum delta (MD) temperature.

Controller 350 in the preferred embodiment preferably calculates the maximum delta (MD) temperature by assuming a default $MD_I$ value, and then it modifies the default value by reducing the final calculated MD based on outside air humidity conditions. The higher the humidity of the outside air, the more the final MD value is reduced. Preferably, the final MD value is within a range of about 0.5 degrees F. to about 12 degrees F. More preferably, MD is within a range of about 1 degree F. to about 8 degrees F. and most preferably MD is within a range of about 2 degrees F. to about 6 degrees F.

The controller 350 optimizes defrosting of the coil by anticipating the frost threshold at all normal operating conditions, preventing and overcoming frost build-up on the coil while remaining in the heating mode, and does not instruct the reversible heat pump system to perform a refrigerant cycle inversion during the vast majority of operating cycles.

If after the predetermined period of compressor runtime or 10 minutes MD is not met, the compressor run time counter returns to zero and begins to count anew. If after any 10 minute compressor run, MD is achieved or exceeded, the timer stands at 10, and the control processor begins to modulate the proportional reversing valve. As the valve modulates further to counteract frost, and indoor air temperature drops, the indoor unit supply air thermistor $T_I$ signals the controller 350 to instruct the fan control 354 to slow sufficiently to maintain a minimum temperature, preferably 110° F. at the outlet. If the temperature of the indoor discharge air should drop to 105° F. for more than predetermined period of time, which could preferably be 30, 60, or 90 seconds, backup heat will be energized by the controller 350 sufficiently to maintain 110° F. minimum discharge air temperature.

Simultaneously, based on a plot of outdoor coil temperature rise versus rate of rise, via adaptive intelligence the controller 350 will in the preferred embodiment slow or stop the outdoor fan, and computes the necessary travel, rapidity and duration of valve modulation, and the coil temperature target (CTT) necessary to return the unit to a steady state, having overcome the frost threshold. The difference between the outdoor coil temperature at the time of defrost cycle initiation and the coil temperature target (CTT) shall be referred to as the modulation temperature range. If at any time the compressor discharge rises to a predetermined maximum temperature, which in the preferred embodiment is about 225° F. (the preferred value will vary according to compressor manufacturer specifications), preferably the controller 350 will prioritize compressor protection and modulate the proportioning reversing valve 300 back away from the anti-frost function to control the discharge temperature. (Optional desuperheating techniques may be controlled by the control processor as applied, to achieve this function instead.) Once the compressor discharge temperature is stabilized, the controller 350 continues to try to achieve its computed CTT. When the CTT based on the prevailing conditions is reached, the controller will drive the valve back to full heat position, and ramp the outdoor fan up to full speed. The indoor coil temperature will rise, the indoor fan control will tamp up the fan, and the compressor run timer will reset to zero and the cycle will start anew.

Superheat is measured in different ways at various points in the refrigeration cycle for various reasons, which the controller is able to measure and accommodate. The superheat discussed here is the most common use, and is known as the pressure/temperature based superheat, often called evaporator (or "cold coil") superheat. Pressure/temperature based superheat is measured the temperature difference between the sensible temperature read at the outlet of the evaporator, and the temperature based on pressure at the evaporator outlet, as converted from a refrigerant temperature pressure chart. Pressure transducers $P_{ICI}$, $P_{ICO}$ and $P_{OCI}$, $P_{OCO}$ and temperature sensors $T_{ICI}$, $T_{ICO}$ and $T_{OCI}$, $T_{OCO}$ are used in conjunction with controller 350 to control electronic expansion valves $E_O$, $E_I$ or with electronic or solenoid refrigerant bypass valves (e.g., $V_B$) or electronic evaporator pressure regulating valves (PRV's) that are usually found in larger commercial systems, not shown. Pressure transducers also allow for pressure/temperature based superheat control in conjunction with 350. These pressure measurements further can be used as an option in establishing MD, modulation initiation temperature, and in prioritizing other aspects of control.

One particularly advantageous aspect of a system and process according to a preferred embodiment of the invention is that the system will be able to control discharge temperature at the compressor, and thereby:

1.) Protect the compressor and system from damage resulting from high discharge temperatures, high compression ratios, and/or low evaporator temperatures, and;
2.) Control and substantially elevate overall system performance and efficiency, and;
3.) Substantially increase compressor volumetric efficiency. It is anticipated that volumetric efficiency could be increased by 25% or more in certain operating conditions. Volumetric efficiency (hereinafter, VE) is defined as the ratio of the actual volume of the refrigerant gas pumped by the compressor to the volume displaced by the compressor pistons (scroll, screw, etc.) A high VE means that more of the piston's cylinder volume is being filled with new refrigerant from the suction line and not re-expanded width clearance volume gases. The higher the VE, the greater the amount of new refrigerant that will be introduced into the cylinder with each 'down-stroke' (inlet stroke) of the piston, and thus more refrigerant will be circulated with each revolution of the crankshaft (scroll, screw, etc.). The compressor's VE depends mainly on system pressures.

The compressor's volumetric efficiency depends mainly on system pressures. In fact, the farther the discharge pressure's magnitude is from the suction pressure's magnitude (in other words, the higher the compression ratio), the lower the VE is because of the more re-expansion of discharge gases to the suction pressure before the suction valve opens. Since compression ration is the ratio that measures how many times greater the discharge pressure is than the suction pressure; i.e.: their relative magnitudes; a compression ratio of 10:1 indicates that the discharge pressure is 10 times as great as the suction pressure, and a certain amount of re-expansion of vapors will occur in the cylinder before new suction gases will enter.

This is why lower compression ratios will cause higher VE's, and lower discharge temperatures. A reversible heat pump system constructed according to the invention is able to keep compression ratios as low as possible during cycles, by keeping condensing (or indoor for heating) pressures low, and suction (or outdoor for heating) pressures high. The system will now have better capacity and higher efficiency. It follows, that the lower the discharge pressure, the less re-expansion of discharge gases to suction pressure. Furthermore, the higher the suction pressure, the less re-expansion of discharge gases, because of the discharge gases experiencing less re-expansion to the higher suction pressure and the suction valve(s) will open sooner.

Although some of the above embodiments are discussed in terms of heating, it is to be understood that this is applicable to refrigeration and vice versa. Other control techniques may be achieved using optional inputs and outputs for various humidity control, superheat control, capacity control, unloaded and ramped, or soft compressor start, demand factor management, pump down control, low ambient control, and other methods that will be evident to one familiar with the art from the optional I/O's mentioned above, but not described in detail here.

The system supersedes conventional prior art reversing valve technology, hot gas bypass valves and systems including capacity control and hot gas defrost, conventional compressor unloading, electric defrost, and 2 speed and variable speed compressor technologies, with greater precision and versatility, and at a low cost.

Figure 13:
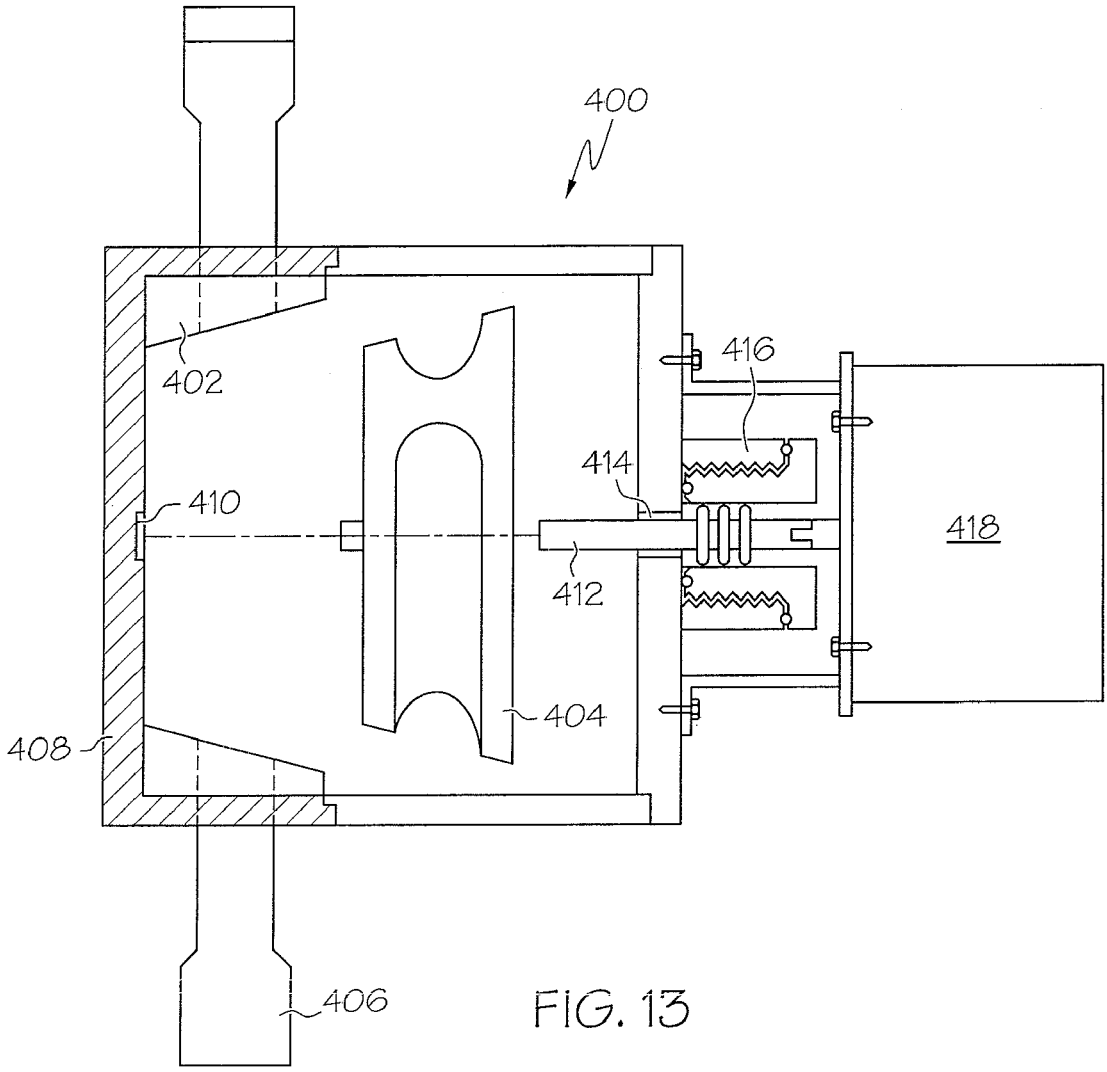
FIG. 13 is a cross-sectional view of a rotating valve that is constructed according to an alternative embodiment of the invention.
Figure 14:
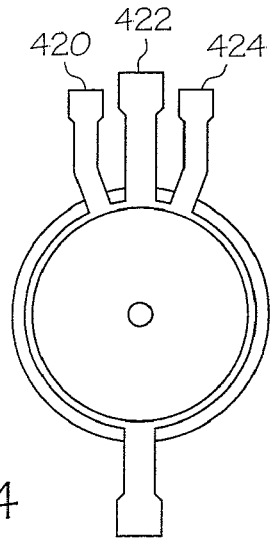
FIG. 14 is an end elevational view of the rotating valve that is depicted in FIG. 13.

FIGS. 13 and 14 depict a rotating modulating motorized proportioning reversing valve 400 (4 way) having a valve body 408 that is constructed according to an alternative embodiment of the invention. Valve 400 has a slightly conical valve plate 402 and valve seat 404 to facilitate a good seal, thereby minimizing internal bypassing of fluid between the ports. An inlet port 406 and outlet ports 422, 424, 426 are in communication with ports defined in the valve plate 402. Valve seat 404 is mounted for rotation on a shaft 412, which extends slightly beyond valve seat 404 into a recess 410 that is provided in the valve body for alignment purposes. Shaft 412 is sealed with respect to valve body 408 by a PTFE bearing 414 and a shaft seal assembly 416. A modulating motor 418 is provided for driving the shaft 412. Modulating motor 418 is preferably an electric stepper servo motor. The tighter one pushes the valve seat 404 into the mating wedged valve plate 402, the closer the tolerance. This allows for setting the tolerance during assembly insuring a tight valve with free motion.

Another alternative embodiment of the system would be a capacity controlled frostless heat pump system utilizing dual reversing valves. This system would include a refrigeration compressor; a 3 port motorized proportioning hot gas reversing valve a rotary valve as described herein, but in a simple 3 port configuration, such as a solid core lateral motion valve or a valve constructed in a guillotine configuration. The compressor discharges hot gas to the common port of the 3 port modulating reversing valve. The hot gas is sent directly to the indoor evaporator coil across which air is blown to heat the controlled space. As heat is extracted for use in the space, the refrigerant condenses, and travels to a system reversing port on the 4 port valve. The condensed liquid refrigerant travels through the reversing valve to the common stationary port and travels to the outdoor expansion valve. The liquid refrigerant is expanded, which drops the temperature and pressure, and the low pressure low temperature expanded liquid is fed into the condenser coil across which a fan blows air and heat is extracted from the ambient. As the refrigerant in the outside coil evaporates, frost or ice is formed increasingly on the outdoor coil. The suction vapor then returns through a suction line accumulator (which traps any remaining liquid that did not boil off, which may slug the compressor) to the compressor where it is recompressed to begin the cycle again. When a selected 'frosting' threshold parameter is met to initiate defrost of the outdoor coil, the outdoor fan is slowed or shut off, and the hot gas valve modulates to raise the suction pressure thereby raising the condenser pressure/temperature and preventing ice build up, or in extreme cold, melting the ice on the coil if frost has begun build-up. If the controls determine that the 3 port valve must modulate to near balance point or balance point, thereby sending high volumes of hot gas to both coils, effectively bypassing both expansion valves during defrost, and the suction gas temperature exceeds the compressor specifications, the indoor fan remains on (though possibly slowed to keep the discharge air temperature up due to reduced capacity) the 4 port valve may modulate back toward the cooling position to a point where the condensed liquid is expanded across the reversing valve to the suction (if the system is equipped with a modulating as opposed to a conventional snap acting 4 port valve), and thus the 4 port modulating reversing valve is used as a desuperheating valve, desuperheating the suction line while in the unit is defrosting while in the heating mode (or cooling mode in the case of refrigeration systems.) The same type of control is employed in situations where compressor superheat becomes too high during capacity control of the system, in either the heating or the cooling mode. The above can also be termed as a true "continuous defrost" or "frostless" system. If a prior art 4 port snap acting reversing valve is used in the system, a desuperheating valve may have to be added. Note: the check valves in the system are to prevent both back flow and commingling of liquid and hot gas refrigerant. If electric positive shut off expansion valves are used no check valve is required in after the expansion valves before entering the coils. However, the hot gas checks are still desirable.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A method of operating a reversible heat pump system, comprising steps of:

(a) sensing an outdoor air temperature with a first sensor;

(b) sensing at least one condition of an outdoor heat exchanger coil with a second sensor;

(c) electronically analyzing input received from said first sensor and said second sensor to predict when frosting on said outdoor heat exchanger coil may be imminent; and (d) modulating a proportioning reversing valve in response to said electronic analysis when the frosting on said outdoor heat exchanger coil may be imminent is predicted, said proportioning reversing valve directing a controlled proportional backpressure of pressurized refrigerant from a pressure side of a compressor into an outlet side of said outdoor heat exchanger coil while pressurized refrigerant is continued to be supplied to an indoor heat exchanger coil, whereby the pressure and temperature of refrigerant within said outdoor heat exchanger coil is raised to at least an extent necessary to prevent frosting on said outdoor heat exchanger coil without completely reversing the refrigeration cycle.

2. A method of operating a reversible heat pump system according to claim 1, further comprising a step of sensing outdoor air humidity.

3. A method of operating a reversible heat pump system according to claim 1, wherein said step of sensing at least one condition of an outdoor heat exchanger coil with a second sensor comprises sensing a temperature of an outdoor heat exchanger coil with said second sensor.

4. A method according to claim 1, wherein said steps of sensing an outdoor air temperature with a first sensor; sensing at least one condition of an outdoor heat exchanger coil with a second sensor; electronically analyzing input received from said first sensor and said second sensor to predict when frosting on said outdoor heat exchanger coil may be imminent; and modulating a proportioning reversing valve in response to said electronic analysis when frosting on said outdoor heat exchanger coil may be imminent is predicted, said proportioning reversing valve directing a controlled proportional backpressure flow of pressurized refrigerant from a pressure side of a compressor into an outlet side of said outdoor heat exchanger coil while pressurized refrigerant is continued to be supplied to an indoor heat exchanger coil are performed continuously in a feedback control loop without inverting the refrigerant cycle.

5. A method according to claim 1, wherein said step of electronically analyzing input received from said first sensor and said second sensor to predict when frosting on said outdoor heat exchanger coil may be imminent comprises determining an outside air temperature; determining a modulation initiation temperature based at least in part on said outside air temperature; and predicting when frosting on said outdoor heat exchanger coil may be imminent based upon whether the temperature of said outdoor heat exchanger coil is sensed to be beneath said modulation initiation temperature.

6. A method according to claim 1, wherein said step of modulating a proportioning reversing valve in response to said electronic analysis when it is predicted that frosting on said outdoor heat exchanger coil may be imminent comprises controlling a distance of travel of said proportioning reversing valve.

7. A method according to claim 1, wherein said step of modulating a proportioning reversing valve in response to said electronic analysis when it is predicted that frosting on said outdoor heat exchanger coil may be imminent comprises controlling a speed of travel of said proportioning reversing valve.

8. A method according to claim 1, wherein said step of modulating a proportioning reversing valve in response to said electronic analysis when it is predicted that frosting on said outdoor heat exchanger coil may be imminent comprises controlling an amount of time that said proportioning reversing valve is modulated.

9. A method according to claim 1, further comprising a step of calculating a rate of rise of a temperature of an outside heat exchanger coil, and wherein said step of modulating a proportioning reversing valve in response to said electronic analysis when it is predicted that frosting on said outdoor heat exchanger coil may be imminent comprises controlling movement of said proportioning reversing valve in response to said calculated rate of rise.

10. A method according to claim 9, wherein a distance of travel of said proportioning reversing valve is controlled in response to said calculated rate of rise.

11. A method according to claim 9, wherein a speed of travel of said proportioning reversing valve is controlled in response to said calculated rate of rise.

12. A method according to claim 9, wherein an amount of time that said proportioning reversing valve is modulated is controlled in response to said calculated rate of rise.

13. A method according to claim 1, further comprising monitoring compressor discharge temperature, and modulating said proportioning reversing valve in order to reduce compressor discharge temperature in the event that compressor discharge temperature exceeds a predetermined maximum.

14. A method according to claim 5, wherein said step of determining said modulation initiation temperature comprises considering outdoor air humidity.

15. A method according to claim 5, wherein said step of determining said modulation initiation temperature comprises considering an outdoor heat exchanger coil design temperature for said reversible heat pump system.

16. A method according to claim 15, wherein said step of determining said modulation initiation temperature further comprises determining if a measured outdoor heat exchanger coil temperature is less than a target heat exchanger outdoor heat exchanger coil temperature by more than a predetermined maximum temperature difference.

17. A method according to claim 16, wherein said predetermined maximum temperature difference is within a range of 0.5° F. to 12° F.

18. A method according to claim 17, wherein said predetermined maximum temperature difference is within a range of 1° F. to 8° F.

19. A method according to claim 18, wherein said predetermined maximum temperature difference is within a range of 2° F. to 6° F.

20. A method according to claim 16, further comprising a step of calculating said predetermined maximum temperature difference, and wherein said step of calculating said predetermined maximum temperature difference comprises considering outdoor air humidity.

21. A method according to claim 1, wherein said step of modulating a proportioning reversing valve in response to said electronic analysis when it is predicted that frosting on said outdoor heat exchanger coil may be imminent is performed with a proportioning reversing valve comprising a movable valve element that is configured to travel in a linear path.

22. A reversible heat pump system, comprising:

a compressor;

an indoor heat exchanger;

a first expansion valve;

a second expansion valve;

an outdoor heat exchanger;

a linear proportioning reversing valve that is in communication with both an inlet and an outlet port of said compressor, said linear proportioning reversing valve being configured to permit said reversible heat pump system to be switched over between heat pump operation and air-conditioning operation, said linear proportioning reversing valve further being constructed and arranged to allow for a controlled proportional flow of pressurized refrigerant from the outlet of the compressor through said linear proportioning reversing valve into said indoor heat exchanger and a controlled backpressure into an outlet side of said outdoor heat exchanger simultaneously without completely reversing the refrigeration cycle when frosting on said outdoor heat exchanger coil may be imminent, said linear proportioning reversing valve comprising a valve member that is mounted for movement along a linear path of travel; and a controller, said controller being constructed and arranged to control operation of said linear proportioning reversing valve.

* * * * *